United States Patent [19]

McDonagh et al.

[11] 4,441,352

[45] Apr. 10, 1984

[54] VERTICAL MILL

[75] Inventors: Andrew J. McDonagh, Pittsburgh; Charles B. Duke, Clairton, both of Pa.

[73] Assignee: Mesta Engineering Company, Pittsburgh, Pa.

[21] Appl. No.: 341,205

[22] Filed: Jan. 21, 1982

[51] Int. Cl.[3] ..... B21B 35/14; B21B 35/00; B21B 31/08

[52] U.S. Cl. ..... 72/249; 72/238; 403/359

[58] Field of Search ..... 72/249, 239, 238, 237; 464/151, 158; 403/359, 335, 364

[56] References Cited

U.S. PATENT DOCUMENTS

| | | | |
|---|---|---|---|
| 1,880,468 | 10/1932 | Nye | 72/249 |
| 1,891,579 | 12/1932 | Schreck | 72/239 X |
| 2,049,842 | 8/1936 | Kling | 72/238 |
| 2,195,502 | 4/1940 | Smitmans | 72/238 |
| 2,311,075 | 2/1943 | O'Malley | 72/249 X |
| 2,332,859 | 10/1943 | Kreissig et al. | 72/249 X |
| 2,565,928 | 8/1951 | O'Malley | 72/239 |
| 2,575,231 | 11/1951 | O'Malley | 72/239 |
| 2,583,844 | 1/1952 | Hill et al. | 72/239 |
| 2,730,387 | 1/1956 | White | 403/359 X |
| 2,752,804 | 7/1956 | Halberkamp | 72/249 X |
| 2,870,664 | 1/1959 | Lobkowitz | 72/239 X |
| 3,160,037 | 12/1964 | Russell et al. | 72/238 |
| 3,490,262 | 1/1970 | Adair . | |
| 3,583,196 | 6/1971 | Qualey . | |
| 3,670,587 | 6/1972 | Lemper | 72/239 |
| 4,094,174 | 6/1978 | Okuda et al. | 72/238 |
| 4,124,999 | 11/1978 | Hirasawatsu et al. | 72/238 X |

FOREIGN PATENT DOCUMENTS

| | | | |
|---|---|---|---|
| 2028465 | 3/1980 | United Kingdom | 464/158 |

*Primary Examiner*—Francis S. Husar
*Assistant Examiner*—Steven B. Katz
*Attorney, Agent, or Firm*—Buell, Blenko, Ziesenheim & Beck

[57] ABSTRACT

A vertical rolling mill is disclosed wherein a means for driving the mill rolls is comprised of a rigid vertical spindle having universal joints and couplings at either end which is detachably connected to the mill roll at its lower end and connected to a splined driving member at its upper end. The splined driving member consists of two parts. First, a hollow sleeve is mounted vertically in a drive case on the mill frame. The sleeve is supported within the frame through top and bottom antifriction bearings. It has internal splines at the lower end of its bore and an internal shoulder above the spline end. Second, a vertical shaft with an external spline and collar is inserted into the sleeve. The vertical shaft engages the internal spline of the sleeve and is supported by its collar which rests on the internal shoulder in the sleeve. Thus, the top frame, rather than the mill roll bearing, supports the weight of the spindle, joints and pod coupling.

7 Claims, 3 Drawing Figures

VERTICAL MILL

The present invention relates to rolling mills of the type having vertical rolls rotatably mounted in a stand and driven from above by a motor, shaft, and gears. These mills are commonly used for working metal slabs and billets.

Vertical rolling mills have long been used in the metal forming and processing industries. These mills have several common features. Typically two or more vertical mill rolls are rotatably mounted in pairs on a housing or stand in a manner such that a workpiece can pass between each pair of rolls. Each pair of rolls is mounted in such a manner that they can be moved laterally so that the distance between them can be adjusted to accomodate workpieces of various sizes. The rolls are rotated through a drive means connected to either the top or bottom of the roll. Top driven rolls are usually driven by a motor located above the roll and connected to the roll through a drive train and spindle. Typically universal joints are provided at either end of the spindle with a pod type coupling connecting the joint to the roll. This permits the roll to move laterally while the drive gears and motor remain fixed. The amount of lateral movement is limited by the length of the spindle and the type of joints used. Mills of this type are exemplified in U.S. Pat. No. 3,670,587 to Lemper. In the top-driven mills of the prior art the drive spindle rests on top of the roll. Thus, the weight of the drive spindle, joints and pod coupling must be supported by the mill roll and the bearings on which the roll rests.

The mill rolls in all vertical rolling mills are subject to wear and therefore must be replaced periodically. To replace top driven rolls it is necessary to lift the drive spindle off the roll. Sometimes the spindle is lifted to a sufficient height to permit the roll to be vertically removed. Other times the spindle is lifted a short distance off the roll and tied to one side. Then the roll is moved laterally and lifted out of the frame. In either case, sufficient space must be provided above the mill for a crane to lift the spindle a sufficient distance to permit removal of the roll.

We provide a vertical rolling mill in which the roll drive spindle, joint and coupling are supported by the mill frame rather than the mill roll. We accomplish this by providing a substantially hollow sleeve with internal splines and an internal shoulder, supported in antifriction bearings and fitted into an aperture in the frame above the mill roll. A vertical shaft having external splines and a collar is inserted into the sleeve so that its splines engage the internal splines of the sleeve. In addition, the collar rests upon the internal shoulder of the hollow sleeve. The bottom of the splined vertical shaft is attached to the top joint of the drive spindle. In this manner the vertical spline shaft and attached couplings, spindle and pod coupling are supported on a shoulder in the sleeve which rests on the mill frame.

Although slipper and spade joints or a slipper and spade-cardan joint combinations will work, we prefer to provide a cardan type universal joint at each end of the drive spindle rather than a slipper and spade joint. A pair of cardan type universal joints will permit the spindle to move through a 10° arc whereas a slipper and spade cardan universal joint combination will permit only a 6° spread. Because universal joints permit greater spread movement spindle length can be substantially shorter and less expensive. This will lessen the overall height of the mill and result in lower headroom requirements for roll changes. Another advantage of the double cardan universal joint construction is that the angular velocity of the shaft is more uniform because the disruptive forces created at each joint cancel one another.

We also prefer to provide a rigid spindle which will have a longer life than a telescoping spindle which is subject to wear whenever the mill rolls are moved laterally.

Other details, objects and advantages of the invention will become apparent as the following description of a present preferred embodiment of the invention proceeds.

In the accompanying drawings I have shown a present preferred embodiment of the invention in which.

Figure 1:
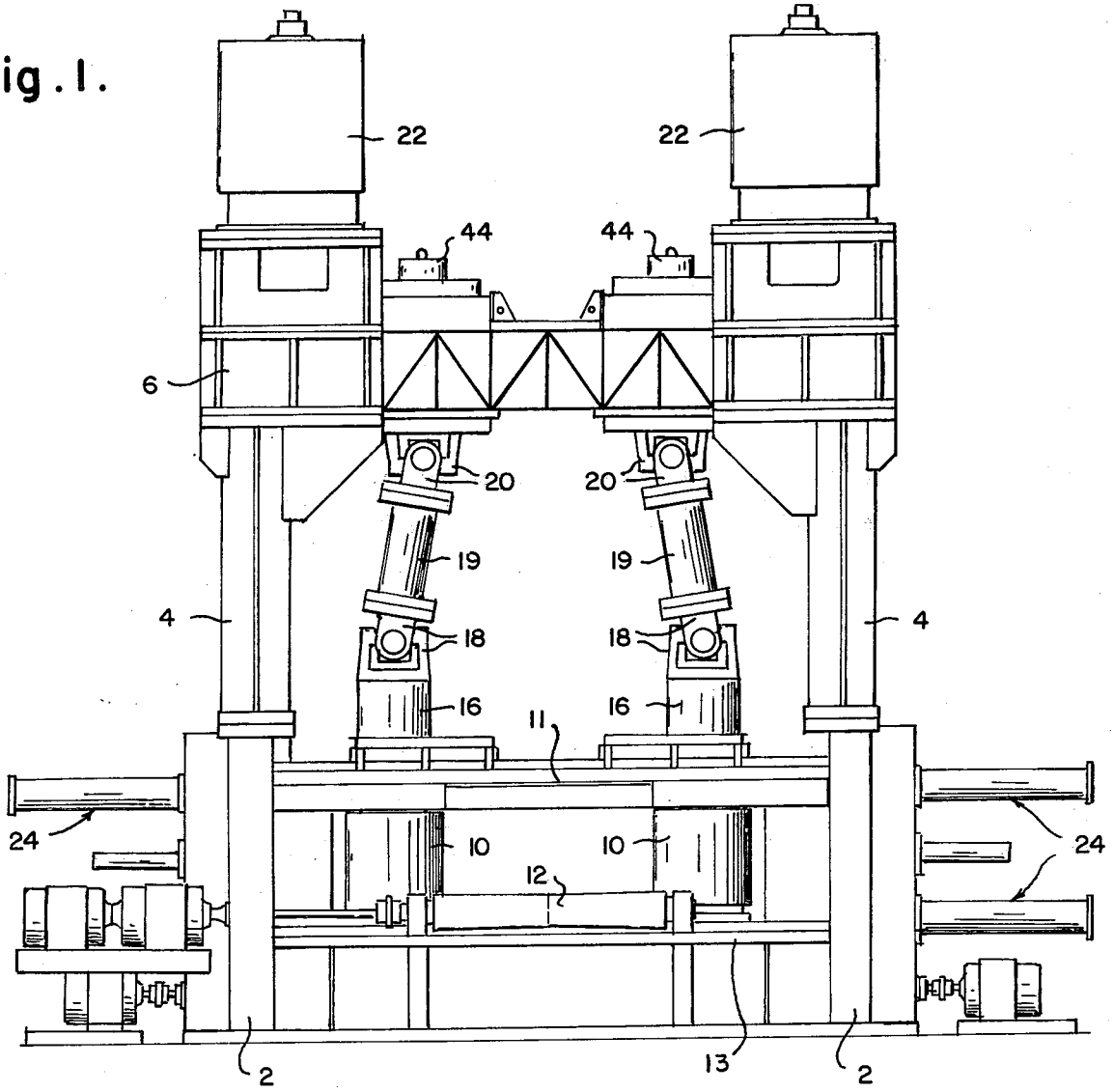
FIG. 1 is a front elevational view of a vertical edging mill utilizing a present preferred embodiment of our invention.
Figure 2:
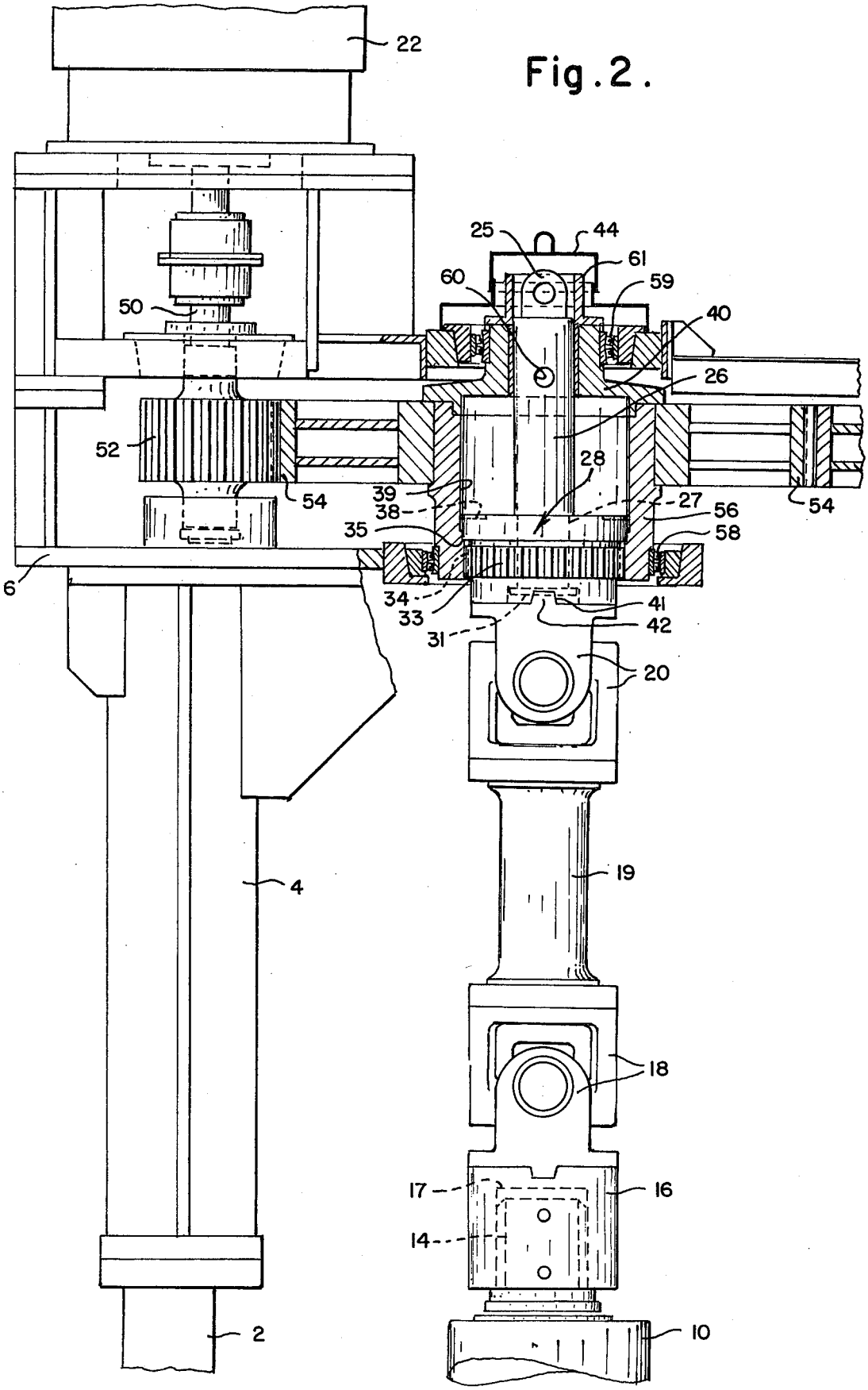
FIG. 2 is an elevational view partially in cross-section of the upper left quarter of the mill shown in FIG. 1 illustrating the drive and support mechanism of a present preferred embodiment of our invention.
Figure 3:
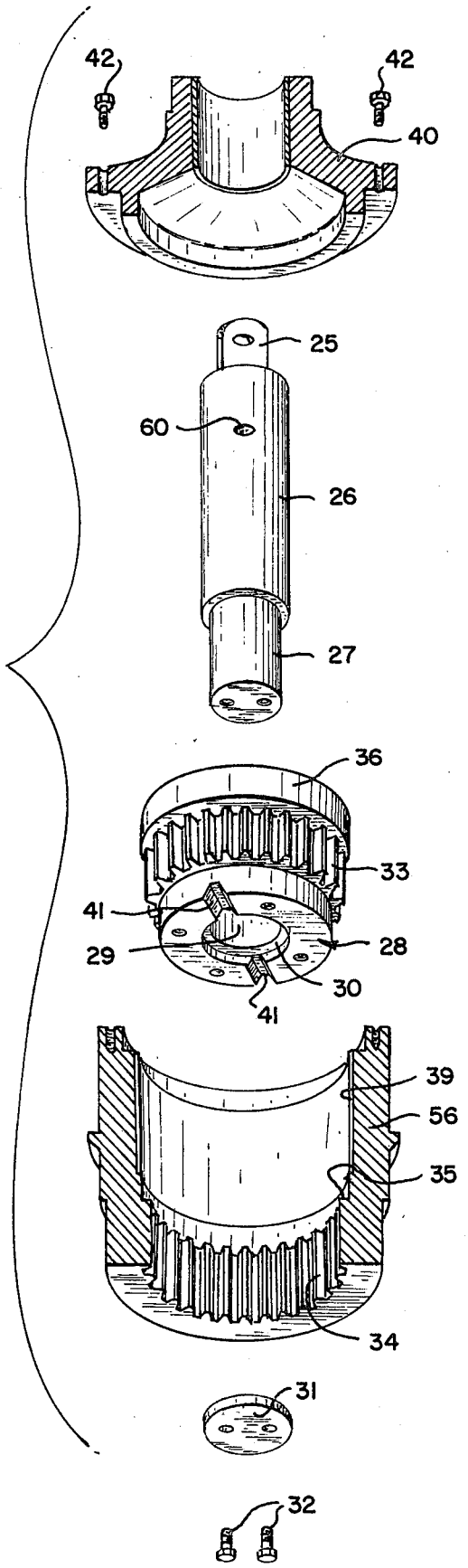
FIG. 3 is an exploded cross sectional view of the drive and support mechanism.

Referring to FIG. 1, a vertical mill is provided having a frame comprised of a base 2, columns 4 and top drive case beam 6. A pair of vertical rolls 10 are positioned in parallel and spaced so that a workpiece riding on horizontal roll 12 may pass between the vertical rolls. The vertical rolls 10 are rotatably mounted on supports 11 and 13. Driving flats 14 (FIG. 2) are provided on the top end of the rolls over which coupling 16 is fitted. This coupling has a cavity 17 sized to accept the flats. Each flat 14 and cavity 17 are suitably shaped so that motion of the coupling will be transmitted to the mill roll through the flats. With this arrangement the coupling will move relative to the roll when the mill roll is moved laterally. A cardan universal joint 18 connects coupling 16 to spindle 19. The spindle 19 is attached to a second universal joint 20 which is bolted to a vertical splined shaft assembly comprised of shaft 26 and splined body member 28 (FIGS. 2 and 3). A motor 22 is connected to universal joint 20 through a drive train shown in FIG. 2. Means 24 (FIG. 1) are provided for moving the vertical rolls in a lateral direction. These lateral movement systems are well known in the art (e.g. Lemper U.S. Pat. No. 3,670,587) and need not be described in detail here.

The drive train shown in FIG. 2 includes a shaft 50 flexibly coupled to motor 22. Gear 52 mounted on shaft 50 engages webbed ring gear 54. Ring gear 54 encircles and is keyed into sleeve 56 which rests on the top drive case beam 6 through bearings 58. As shown more clearly in FIG. 3, splines 34 and internal shoulder 35 are provided about the interior of sleeve 56. A vertical spline shaft assembly is fitted into sleeve 56. This assembly is comprised of shaft 26 having a clevis 25 and a neck 27 at its other end which is of smaller diameter than the shaft. The neck 27 of shaft 26 is inserted into a splined body member 28 having an internal bore 29 sized so that only neck 27 of shaft 26 will fit into the bore and the shaft 26 will not pass through the bore. The shaft is held in place by cap 31 which fits into recess 30 and is attached to the neck 27 by screws 32. The splined body member has external splines 33 sized to engage internal splines 34 of sleeve 56 and a collar 36 sized to rest upon sleeve shoulder 35. Keys 38 are provided in the splined body member 28 which fit into keyways 39 on sleeve 56. We prefer to construct splined body member 28 so that the splined end is of greater diameter than universal joint 20 to permit the joint to be raised past internal splines 34 for roll changing. Furthermore, the length of the splines 33 should be shorter than the depth of the internal splines 34 which will permit the collar 36 of the splined body member 28 to rest on the top shoulder 35 of sleeve 56. Finally a cover 40 is fitted onto collar 56 and held in place by bolts 42. The top universal joint 20 (FIG. 2) is bolted to the bottom of the splined body member 28. Driving slots 41 are provided in the splined body member 28 to accomodate the rib keys 42 provided on the top of joint 20. Bearings 59 are provided between the frame and the cover 40. Dust cover 44 is provided to keep dirt from the bearings.

Roll changes can be made easily in the present preferred embodiment of our invention. For a roll change, cover 44 is removed. Then shaft 26 is lifted by an overhead crane whose hook is attached to clevis 25. As shaft 26 is lifted the attached splined body member 28, universal joints 18 and 20, spindle 19 and coupling 16 will be raised. When the collar 36 of the splined body member reaches the top of sleeve 56 a "safety" pin is inserted in hole 60 of shaft 26. The shaft is then lowered until the pin rests upon support 61 holding the assembly in the raised position. This releases the crane to proceed with the roll change. The roll is moved laterally to a roll change position and removed by the crane. Next a replacement roll is positioned under the coupling. The pin is removed from shaft 26 and the coupling is lowered into place. Keys 38 in the splined body member will keep the splines 33 and 34 in alignment during the roll change process.

While we have shown and described a present preferred embodiment of the invention and have illustrated a present preferred method of practicing the same, it is to be distinctly understood that the invention is not limited thereto and may be variously embodied within the scope of the following claims.

We claim:

1. A vertical rolling mill comprising:

(a) a housing, (b) a plurality of mill rolls rotatably mounted on the housing in a substantially vertical position, and (c) a drive means for each roll comprising (i) a rigid spindle, (ii) an upper joint and a lower joint attached to the spindle, (iii) a detachable coupling connected to the lower joint and movably attached to the roll, (iv) a substantially hollow cylindrical sleeve having longitudinal interior splines at one end and an interior shoulder about its interior, (v) a vertical spline shaft having a collar and splines at one end and sized so that the splines will fit into the sleeve and engage its splines, and the collar will rest on the sleeve shoulder and attached at splined end to the upper joint, (vi) a support member attached to the rolling mill, positioned substantially above the mill roll, and on which the sleeve rests, having an aperture sized so that the sleeve will not pass through the aperture and the spline shaft can be connected to the upper joint through the aperture, and (vii) means connected to said sleeve for rotating the spindle.

2. The vertical rolling mill of claim 1 wherein the detachable coupling is comprised of a male member attached to the roll and a female member attached to the joint and sized in a manner that when joined together rotary motion of the female member will be transmitted to the male member.

3. The vertical rolling mill of claim 1 wherein the upper and lower joints are cardan universal joints.

4. The vertical rolling mill of claim 1 also comprising a means operatively connected to said rolls for moving the rolls independently and laterally.

5. The vertical rolling mill of claim 1 wherein the diameter of the upper universal joint is smaller than both the diameter of the aperture in the support member and the diameter of the vertical spline shaft at its splines.

6. The vertical rolling mill of claim 1 wherein the vertical spline shaft is comprised of (a) a substantially cylindrical splined body member having a bore through its interior, a recess at one end of the bore, exterior splines extending circumferentially about the recessed end, and a collar on its other end, (b) a substantially cylindrical shaft having a neck at the one end sized to fit and extending through the bore in the body member, a main body portion attached to the neck and having a greater diameter than the neck and a clevis attached to the main body member, and (c) a cap sized to fit and located in the recess in the splined body member and attached to the neck of the cylindrical shaft.

7. The vertical rolling mill of claims 1 or 6 wherein at least one keyway is provided in the interior of the cylindrical sleeve, and also comprising at least one key attached to the spline shaft and positioned so as to travel in the keyway.

* * * * *